US006422168B1

(12) United States Patent
Kobayashi

(10) Patent No.: US 6,422,168 B1
(45) Date of Patent: Jul. 23, 2002

(54) SPORTING WATER VEHICLE

(75) Inventor: Noboru Kobayashi, Irvine, CA (US)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 09/603,639

(22) Filed: Jun. 26, 2000

(51) Int. Cl.[7] ..... B63B 35/73; B63B 1/32
(52) U.S. Cl. ..... 114/55.55; 114/291
(58) Field of Search ..... 114/55.5, 55.54, 114/55.55, 55.57, 61.1, 61.12, 61.13, 61.32, 61.33, 290, 291

(56) References Cited

U.S. PATENT DOCUMENTS

| | | | | | |
|---|---|---|---|---|---|
| 3,036,544 | A | * | 5/1962 | Magri | 114/55.54 |
| 3,948,206 | A | * | 4/1976 | Tyler | 114/55.51 |
| RE28,955 | E | * | 9/1976 | Stanberry, Sr. et al. | 114/55.55 |
| 4,744,325 | A | | 5/1988 | Nobayashi | |
| 4,760,810 | A | | 8/1988 | Kobayashi | |
| 4,893,579 | A | | 1/1990 | Kobayashi | |
| 5,170,735 | A | | 12/1992 | Kobayashi | |
| 5,255,626 | A | | 10/1993 | Hattori et al. | |
| 5,309,856 | A | | 5/1994 | Kobayashi | |
| 5,355,826 | A | | 10/1994 | Hattori et al. | |
| 5,390,621 | A | | 2/1995 | Hattori et al. | |
| 5,401,197 | A | | 3/1995 | Kobayashi | |
| RE34,922 | E | | 5/1995 | Hattori et al. | |
| 5,447,116 | A | | 9/1995 | Kobayashi | |
| 5,520,133 | A | * | 5/1996 | Wiegert | 114/125 |
| 5,544,607 | A | * | 8/1996 | Roabaugh et al. | 114/123 |
| 5,584,733 | A | | 12/1996 | Kobayashi | |
| 5,697,317 | A | * | 12/1997 | Pereira | 114/55.52 |
| 5,794,556 | A | | 8/1998 | Kobayashi | |
| 6,000,357 | A | * | 12/1999 | Allison | 114/271 |
| 6,058,873 | A | | 5/2000 | Koyanagi | |

FOREIGN PATENT DOCUMENTS

| | | | | |
|---|---|---|---|---|
| JP | 2-127187 A | * | 5/1990 | 114/55.5 |
| WO | WO-88/01587 | * | 3/1988 | 114/55.5 |
| WO | PCT/US01/41163 | | 6/2001 | |

* cited by examiner

*Primary Examiner*—S. Joseph Morano
*Assistant Examiner*—Andrew Wright
(74) *Attorney, Agent, or Firm*—Knobbe, Martens, Olson & Bear, LLP

(57) ABSTRACT

A watercraft incorporates a vertically elongated displacement hull section to elevate the riders of the watercraft well above the water level when the watercraft is up on plane. During normal low-speed displacement hull-type operation, the elongated displacement hull section remains submerged, and does not appreciably affect the stability of the watercraft. When the watercraft is accelerated to planing speed, however, the elongated displacement hull section rises out of the water, and the watercraft planes on the planing surface disposed at the bottom of the elongated displacement hull section. In this manner, the operator/riders are lifted a significant distance above the surface of the water. The watercraft further incorporates an elongated displacement hull section having a bulged section which is sized to accommodate the watercraft engine within the elongated displacement hull section. This bulged section allows the assembled engine to be installed and/or removed from the watercraft, yet minimizes the overall volume of the elongated displacement hull section, thereby reducing the buoyant forces induced on the watercraft hull by the elongated displacement hull section. The lower position of the engine within the hull also lowers the center of gravity of the watercraft, thereby improving the watercraft's stability and handling characteristics.

62 Claims, 6 Drawing Sheets

SPORTING WATER VEHICLE

BACKGROUND OF THE INVENTION

1. Field of the Invention

The present invention generally relates to a watercraft. More particularly, the present invention relates to an improved personal watercraft design.

2. Description of Related Art

Personal watercraft have become very popular in recent years. These types of watercraft have small hulls (e.g., 13 feet or less in length) that support a straddle-type seat. The hulls typically have either a full V or semi-V shape and are not very deep (e.g., 42 inches (108 cm)). These types of hulls consequently do not displace much water when floating at rest. Additionally, personal watercraft hulls remain relatively close to the water level when up on plane.

The enthusiasm for personal watercraft largely resides its sporty nature. It is becoming more commonplace, however, for local and federal municipalities to limit the engine emission levels and/or operating speeds of personal watercraft. Thus, there is a need for a personal watercraft that can be operated at slower speeds to reduce emission levels, yet can induce in riders a feeling of high speed, sporty operation.

SUMMARY OF THE INVENTION

The present invention involves in part the recognition that increasing the height of a watercraft operator and/or riders above the surface of the water creates in these individuals a "flying" feeling which mimics operation of a watercraft at very high speeds, even when the watercraft is operating at relatively slower planing speeds. The increased height of the rider above the water surface also mimics the feel of riding a motorcycle.

Merely increasing the height of the operator's/riders' seat, however, typically brings with it various disadvantages, including destabilization of the watercraft and/or a significant and unwanted increase in the size and complexity of the watercraft hull. For example, if the seat is extended upwards, such that the operator/riders are suspended farther above the watercraft hull, the watercraft will become significantly more "top-heavy," which tends to destabilize the watercraft at slow speeds and possibly cause it to roll over. Alternatively, if the size of the entire watercraft hull is increased, such that the operator/riders ride higher above the water's surface, the watercraft becomes significantly more expensive and loses much of its appeal as a "compact," "sporty" and highly maneuverable "personal" water vehicle.

The present invention obviates these disadvantages by incorporating into the hull of the watercraft a low-volume elongated displacement hull section having a planing surface upon which the watercraft may plane at higher watercraft speeds. During normal low-speed displacement hull-type operation (i.e., operation at speeds less than the planing speeds), the elongated displacement hull section remains submerged, and does not appreciably affect the stability of the relatively slow moving watercraft. At higher planing speeds, however, the elongated displacement hull section rises out of the water as the watercraft planes upon the planing surface, thereby raising the operator and/or riders a significant distance above the surface of the water.

The increased separation between the operator/riders and the water surface greatly increases the visibility of the planing watercraft. Not only does the increased height of the operator and/or riders allow these individuals to see farther away, but the increased seat height and the increase in the highly visible cross-section of the un-wetted hull of the planing watercraft greatly increases the visibility of the watercraft to other watercraft operators and individuals utilizing the same body of water. Moreover, the increased height of the operator and/or riders can be extremely useful for individuals utilizing the watercraft in such activities as lifeguarding and/or search and rescue (SAR) operations, where good visibility of the surrounding water surface is desired.

The increased height of the operator and/or riders also significantly reduces the amount of waterspray which strikes the individuals riding the planing watercraft. Where the operator/riders do not wish to be sprayed with water, such as where the ambient temperature of the air/water and/or wind chill factors make waterspray unenjoyable, the increased separation between the operator/riders and the water surface significantly minimizes the amount of water spraying onto the operator/riders. In addition, the operator's visibility improves as water spray from the bow and/or breaking wave tops tends not to fly into the operator's line of sight.

In at least some modes, the present watercraft provides a significant increase in the watercraft's storage capacity as compared to the majority of current personal watercraft models. Because the elongated displacement hull section accommodates essentially the same basic propulsion components as in a standard watercraft, much of the remaining hull volume can be utilized as additional storage space. A preferred watercraft design locates this additional storage space above the elongated displacement hull section.

One aspect of the present invention therefore involves a small watercraft comprising a hull including a lower hull and an upper deck. The lower hull is formed in principal part by an upper section, an intermediate section, and a lower section. The lower section has a planing surface, and the intermediate section lies between the planing surface and a water displacement line of the watercraft. The intermediate section is vertically elongated such that a height of the intermediate section, as defined along a vertical axis, is not less than about half the width of the planing surface.

Another aspect of the present invention involves a small watercraft comprising a hull including a pair of outer chines, an intermediate section, and a lower section defining a planing surface. The outer chines and the lower section are symmetrically positioned relative to a central, longitudinally extending, vertical plane of the hull. The lower section is disposed below and between the outer chines and includes a pair of inner chines defined along outer edges of the lower section. The intermediate section includes a pair of sides. Each side extends between one of the outer chines and a corresponding one of the inner chines. At least a portion of each side also extends inwardly toward the central vertical plane and sufficiently deviates from a line between the corresponding inner and outer chines so as to significantly reduce the volume of the hull beneath the outer chines.

In accordance with a further aspect of the present invention, a small watercraft comprises a hull including an upper section including a pair of outer chines, an intermediate section, and a lower section including a planing surface. The upper section supports an elongated, longitudinally extending seat with a steering column positioned forward of the seat. A propulsion system is also supported by the hull. The propulsion system includes an engine and a propulsion device that is driven by the engine to propel the watercraft. The engine is disposed such that most, if not all, of the engine lies below a vertical level of the outer chines.

An additional aspect of the present invention involves a small watercraft comprising a hull including a lower hull and an upper deck. The lower hull is formed principally by an upper section, an intermediate section, and a lower section. The lower section defines at least part of a planing surface of the watercraft. The intermediate section is disposed between the planing surface and a water displacement line of the watercraft, and has a maximum width that is not greater than the width of the planing surface.

In accordance with another aspect of the present invention, a small watercraft comprises a hull defining a planing surface having a width in a transverse direction. An internal combustion engine is disposed within the hull, and a propulsion device is driven by the engine. The propulsion device also is disposed on the hull and is arranged such that its propulsion axis (e.g., discharge axis) lies near the planing surface of the hull. An exhaust system communicates with the engine and extends to and terminates at an exhaust outlet to discharge exhaust gases generated by the engine from the hull. The exhaust outlet is located near a water displacement line of the watercraft. The propulsion axis of the propulsion device and the exhaust outlet are separated by a vertical distance that is not less than about half of the width of the planing surface.

A further aspect of the present invention involves a small watercraft comprising a hull including a pair of outer chines, an intermediate section, and a lower section defining a planing surface. The lower section is disposed below and between the outer chines, and includes a pair of inner chines along outer edges of the lower section. The intermediate section extends between the outer chines and the inner chines, and is configured to significantly reduce the volume of the hull below the outer chines in comparison to a hull volume defines by a generally v-shape construction between the inner and outer chines so that the hull has a water displacement line significantly higher on the hull.

For purposes of summarizing the invention and advantages achieved over the prior art, certain objects and advantages of the invention have been described above. Not necessarily all such objects or advantages need be achieved in accordance with any particular form of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein. Additionally, further aspects, features, and advantages of the present invention will become apparent from the detailed description of the preferred embodiment which follows.

BRIEF DESCRIPTION OF THE DRAWINGS

The above-mentioned and other features of the invention will now be described with reference to the drawings of a preferred embodiment of the present watercraft. The illustrated embodiment of the watercraft is intended to illustrate, but not to limit the invention. The drawings contain the following figures.

DETAILED DESCRIPTION OF THE PREFERRED EMBODIMENT

The present watercraft, including its hull configuration and component layout, has particular utility in the form of a personal watercraft. The following description thus will focus on this form and will describe a preferred embodiment thereof. Various aspects and features of the present watercraft, however, also have utility in a variety of other small watercraft, such as, for example, speedboats, jet boats, runabouts and the like.

Figure 1:
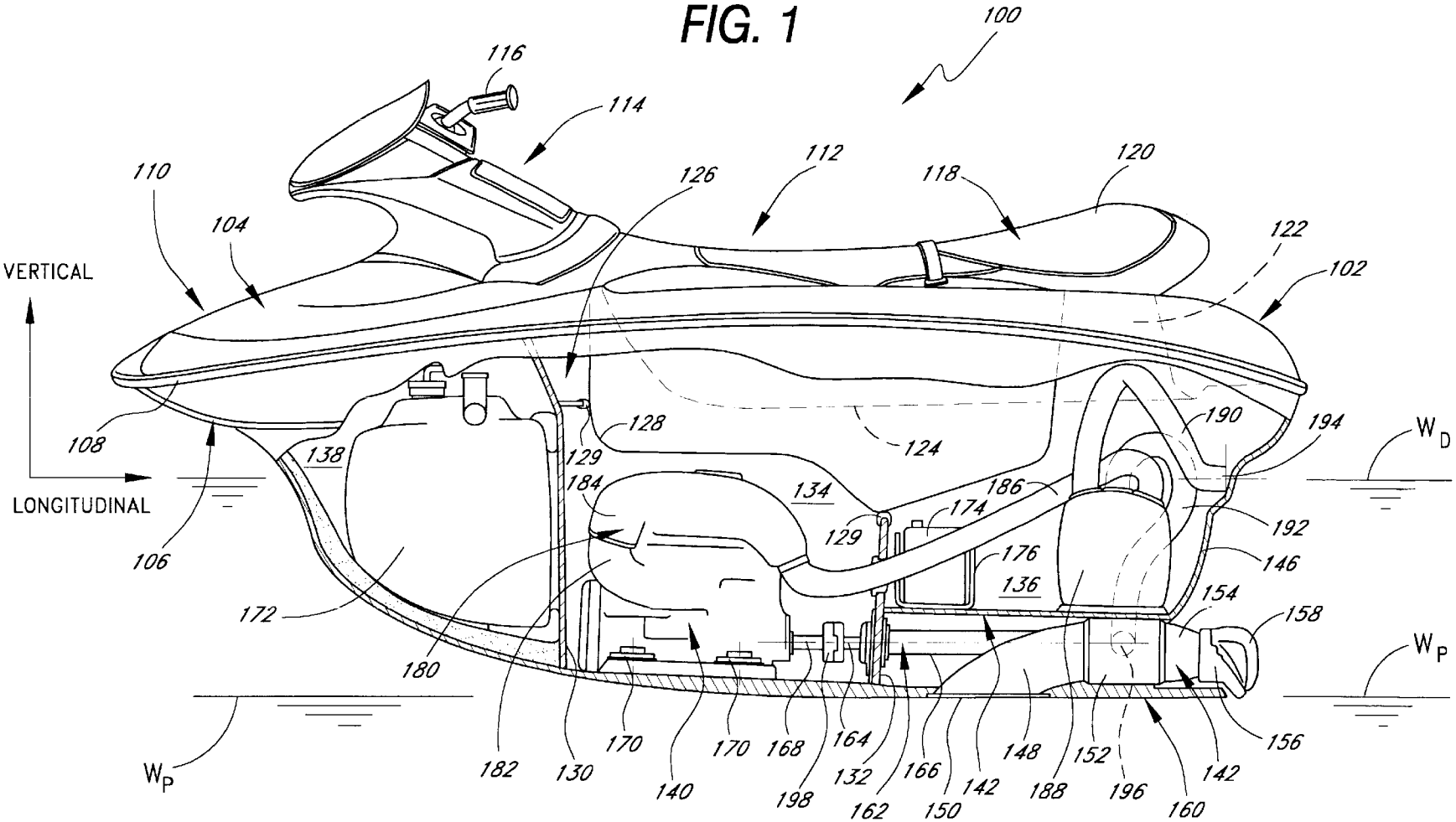
FIG. 1 is a partial sectional side view of a personal watercraft hull constructed in accordance with a preferred embodiment of the present invention.

With reference to FIG. 1, the personal watercraft 100 will be described with reference to a coordinate system. The coordinate system includes a longitudinal axis that extends from the bow to the stern of the personal watercraft 100. A transverse axis lies perpendicular to the longitudinal axis and extends form the port side to the starboard side of the personal watercraft 100. Both the longitudinal axis and the transverse axis lie generally parallel to a surface of a body of water in which the watercraft is to be operated. The coordinate system also includes a vertical axis that lies normal to both the longitudinal and transverse axes (i.e., normal to the water surface).

As seen in FIG. 1, the personal watercraft 100 includes a hull, which is indicated generally by reference numeral 102. The hull 102 can be made of any suitable material; however, a presently preferred construction utilizes molded fiberglass reinforced resin and/or a sheet molding compound. Additionally, various components of the hull can be formed by a suitable lightweight material, such as plastic, especially those components on the upper side of the hull.

The hull 102 is generally divided into an upper deck section 104 and a lower hull 106. A bond flange 108 connects the lower hull 106 to the upper deck section 104. The bond flange 108 is formed by cooperating flange sections that depend downward and extend about the outer periphery of the upper deck section 104 and the lower hull 106. These flange sections preferably are connected together by a suitable marine adhesive and by rivets. Of course, any other suitable means can be used to interconnect the lower hull 106 and the upper deck section 104. Additionally, the lower hull 106 and the upper deck section 104 can be integrally formed. A plastic trim preferably extends around the periphery of the bonding flange 108 to form a conventional bumper.

As viewed in the direction from the bow to the stern of the watercraft, the upper deck section 104 includes a bow portion 110 and a rider's area 112. The bow portion 110 includes a steering column 114 that supports a handlebar assembly 116. In the illustrated embodiment, the steering column 114 extends away from the rider's area 112 in a manner that is similar to a racing motorcycle. This arrangement allows the operator to lean forward when grasping the handlebars. In this arrangement, the operator's feet are preferably placed significantly behind the knees, which hug the sides of the rider's area 112. This arrangement of the steering column 114 is preferred in part because it allows the operator to lean the watercraft lower into turns as will be explained in more detail below. However, it should be appreciated that the personal watercraft 100 may employ a more conventional steering column (i.e., one that extends towards the rider's area 112) and yet still achieve many of the advantages and benefits of the present invention.

The handlebar assembly 116, which extends from the steering column 114, controls the steering of the watercraft 100 in a conventional manner. The handlebar assembly 116 and/or the control mast 114 also carry a variety of controls of the watercraft 100, such as, for example, but without limitation, various gauges and/or displays, a throttle control, a start switch and a lanyard switch.

The rider's area 112 lies behind the control mast 114 and includes a seat assembly 118. In the illustrated embodiment, the seat assembly 118 has a longitudinally extending straddle-type seat which preferably may be straddled by an operator and by at least one passenger. In a preferred form, the seat has a sufficient length to support two people. The seat assembly 118, at least in principal part, is formed by a seat cushion 120 supported on a raised pedestal 122. The raised pedestal 122 forms a portion of the upper deck section 104, and has an elongated shape that extends longitudinally along the center of the watercraft 100 from the control mast 114 toward the aft end of the watercraft 100. The seat cushion 120 desirably is removably attached to a top surface of the raised pedestal 122 by one or more latching mechanisms (not shown) and covers the entire upper surface of the pedestal 122 for rider and passenger comfort. In some modes, the seat cushion 120 can be formed in several pieces, each individually attached to and removed from the seat pedestal 122. In this manner, select sections of the seat cushion 120 can be removed without removing the entire seat cushion 120.

Figure 2:
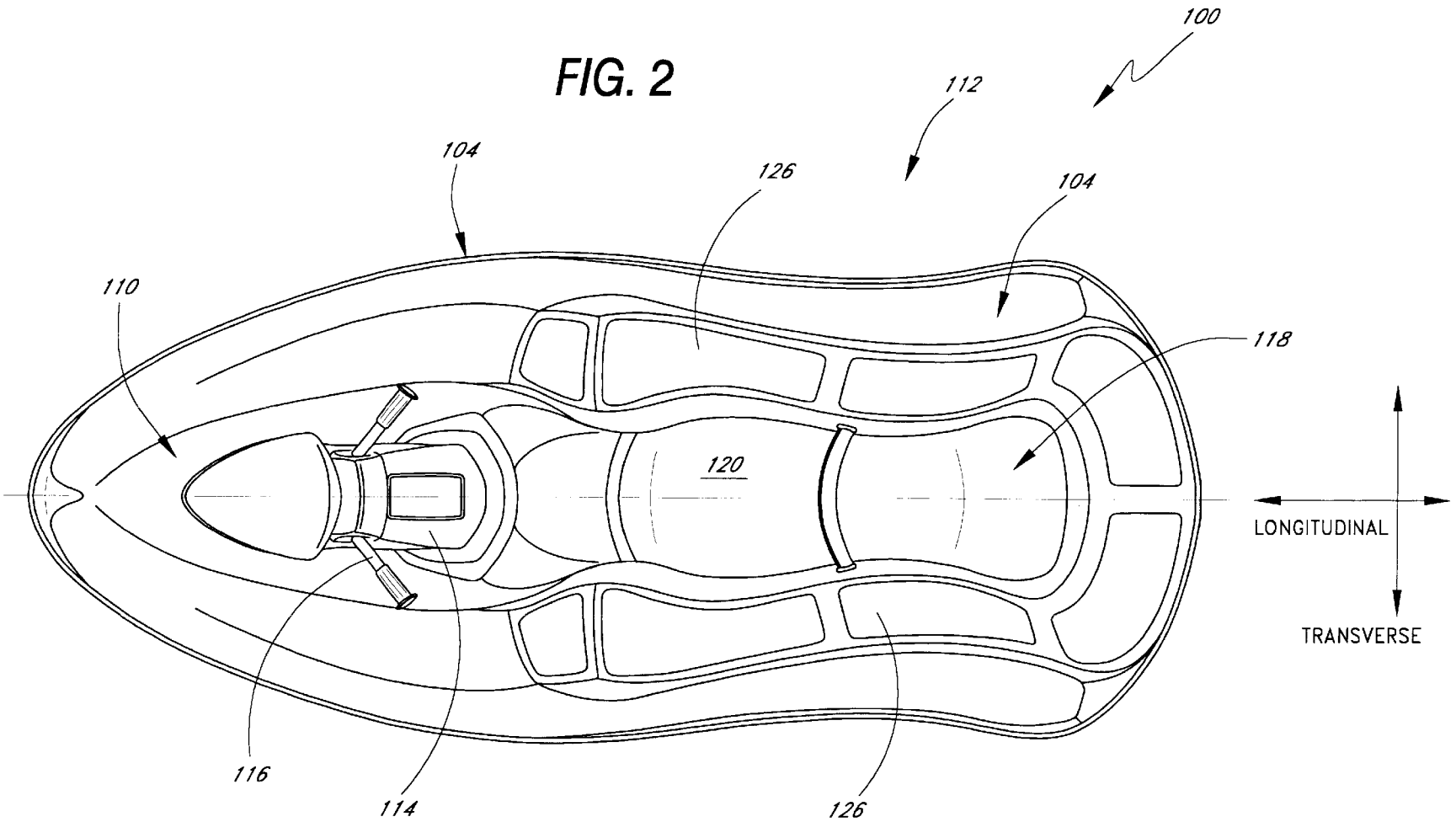
FIG. 2 is a top elevational view of the watercraft of FIG. 1.

The upper deck 104 advantageously includes a pair of longitudinally extending surfaces 124 (FIG. 2) that are positioned on opposite sides of the aft end of the upper deck section 104. The surfaces 124 define a pair of foot areas that extend generally parallel to the sides of the pedestal 122. In this position, the operator and any passengers sitting on the seat assembly 118 can place their feet on the foot areas during normal operation of the personal watercraft 100. A non-slip (e.g., rubber) mat desirably covers the foot areas to provide increased grip and traction for the operator and passengers.

An access opening (not shown) is preferably located in the upper surface of the upper deck 104. The access opening desirably opens into a hull interior 126 formed within the hull 104. At least a portion of the seat cushion 120 covers and seals the access opening. If desired, a seal (not shown), such as a rubber gasket, can be used to ensure the access opening is closed in a watertight manner. When the seat cushion 120 is removed, the interior hull 126 is accessible through the access opening.

As best in FIG. 1, a cargo holder or box 128 is positioned beneath the seat cushion 120 and the access opening, substantially within the hull interior 126 bounded by the raised pedestal 122. Desirably, the cargo box 128 incorporates a flanged upper edge (not shown) which engages the upper surface of the raised pedestal 122 about the access opening (not shown) to suspend the cargo box 128 in position within the hull interior 126. The cargo box 128 can be accessed through the seat assembly 118 in a known manner. If desired, cushions or pads 129 on the bulkheads 130, 132 can be used to secure and support further the cargo box 128 in position, and also to form generally a watertight seal between engine and propulsion compartments 134, 136 and the cargo box 128. The cargo box 128 can be removed from the hull interior 126, thereby allowing access to internal components of the watercraft 100 for maintenance. In the illustrated embodiment, the cargo box 128 lies at least in part below a water displacement line $W_D$ of the watercraft hull 102.

The hull 104 preferably includes a ventilation system that has one or more air inlets (not shown) that communicate with air ducts (not shown) to allow atmospheric air to enter and exit the hull interior 126. Although not illustrated, the air inlets can be formed in the upper deck section 104 of the lower hull 106 and can communicate with the air ducts that open into the hull interior 126 at a point below the upper deck 104. The air intakes and ducts provide a source of fresh air for cooling, and also for combustion when an internal combustion engine is used to power the watercraft. Except for the ventilation system, the hull interior 126 is normally substantially sealed so as to enclose the interior components of the watercraft 100 from the body of water in which the watercraft 100 is operated.

The hull 102 also includes the forward bulkhead 130 and the rear bulkhead 132, each of which reinforces the lower hull 106 internally; however, the hull can be constructed without one or both of the bulkheads 130, 132. Additional bulkheads also can be used.

The forward bulkhead 130 preferably extends from the lower surface of the lower hull 106 to the upper deck 104. In comparison, the rear bulkhead 132 preferably extends from the lower surface of the lower hull 106 into an intermediate section of the lower hull 106. More preferably, the rear bulkhead head extends up to the cargo box 128, as shown in FIG. 1. The bulkheads 130, 132 serve to define, in part, a fuel compartment 138, the engine compartment 134, and the propulsion compartment 136. Each bulkhead 130, 132 preferably is secured to the lower section of the lower hull 106 by a suitable marine adhesive, and more preferably is secured to the hull along the lengths of its sides and bottom edges. The upper edge of the forward bulkhead 130 also can be adhered to the upper deck section 108. In addition or in the alternative, each bulkhead can be attached to the lower hull 106 in the manner described in U.S. Pat. No. 5,921,198, issued Jul. 13, 1999, to the same assignee of this application, the entire contents of which is hereby incorporated by reference.

The watercraft 100 includes a propulsion unit comprising a prime mover and a propulsion device. In the illustrated embodiment, the prime mover is an internal combustion engine 140 that will be described in detail below. However, it should be appreciated that the personal watercraft 100 can employ other types of prime movers, such as, for example, an electric engine. Similarly, the propulsion device in the illustrated embodiment is a jet pump unit 142. However, it should be appreciated that the watercraft 100 can employ other types of propulsion devices such as, for example, a propeller.

In the illustrated embodiment shown in FIG. 1, the jet pump unit 142 is mounted within a tunnel 144 formed on the underside of the lower hull 106 by a plurality of bolts (not shown). The tunnel 144 extends up into and through a lower section of the lower hull 106 (and, in the illustrated mode, up into the intermediate section) and opens through a transom 146 of the watercraft 100. An intake duct 148, which is disposed within or formed by the tunnel 144, extends between the jet pump unit 142 and an inlet opening 150. In the illustrated embodiment, the inlet opening 150 generally faces downward and is disposed on relative flat section of the lower hull 106. The duct 148 leads to the jet pump unit 142 that includes an impeller housing 152 containing an impeller (not shown). The jet pump unit 142 also includes a discharge nozzle 154 located downstream of the impeller.

A steering nozzle 156 is supported at the downstream end of the discharge nozzle 154 by a pair of vertically extending pivot pins (not shown). In an exemplary embodiment, the steering nozzle 156 has an integral level on one side that is coupled to the handlebar assembly 116 through, for example, a bowden-wire actuator, as known in the art. In this manner, the operator of the watercraft 100 can move the steering nozzle 156 to effect directional changes of the watercraft 100. The steering nozzle 156 can also be supported by a gimble ring so that the steering nozzle can be trimmed. The orientation of the steering nozzle defines a propulsion axis. A suitable actuator mechanism is disclosed in U.S. Pat. No. 5,440,174. In addition, a reserve thrust bucket 158, as is well known in the art, can be positioned on the aft end of the jet pump unit 142 to provide reverse thrust for backing-down the watercraft 100.

A ride plate 160 covers a portion of the tunnel 144 behind the inlet opening 150 to enclose the jet pump unit 142 within the tunnel 144. In this manner, the lower opening of the tunnel 144 is closed to provide, at least in part, a planing surface for the watercraft 100. A pump chamber then is defined within the tunnel 144 covered by the ride plate 160.

An impeller shaft assembly 162 supports the impeller (not shown) within the impeller housing 152. The aft end of an impeller shaft 164 is suitably supported and journalled within a compression chamber within the impeller housing 152 in a known manner, and rotates about a generally longitudinally extending axis; however, this impeller axis can be skewed either upwards or downwards in some variations of the watercraft. The impeller shaft 164 extends in a forward direction through a front side of the tunnel 144 and through the bulkhead 132. A protective casing 166 preferably surrounds a portion of the impeller shaft 164 that lies forward of the intake duct 148; however, such casing 166 can be omitted when other conventional types of impeller shaft mounting arrangements are employed with the watercraft.

The impeller shaft 164 is coupled to an output shaft 168 of the engine 140. The engine 140 is mounted within the engine compartment 134 in any suitable manner. For instance, a set of resilient engine mounts 170 may be used to connect the engine 140 to a set of stringers (not shown) of the lower hull 106, to a molded insert piece (not shown) secured (e.g., adhered) to the lower hull 106, or directly to bosses formed onto the lower inner wall of the lower hull 106. Other engine mounting arrangements are also possible to securely support the engine 140 within the hull 104.

The engine 140 preferably is mounted to the lower hull 106 in a central position relative to both the width (in the transverse direction) and the length (in the longitudinal direction) of the watercraft 100. This position can be shifted of course to improve watercraft balance, handling, and performance. For instance, in some applications, the longitudinal position of the engine 140 can be moved rearward in order to shift the center of gravity of the watercraft toward its aft end. The engine 140 for this purpose can be positioned above, partially over, or entirely over the water propulsion unit, the description of which is provided below. In this context, "above" means that an output shaft of the engine 140 is arranged vertically higher than an impeller or drive shaft of the propulsion unit.

The engine 140 may be of various configurations and sizes and can operate on any of a variety of principles. For example, the engine 140 can be an internal combustion engine and can operate on a two-stroke, four-stroke or rotary combustion principle. Additionally, the engine 140 can comprise any number of cylinders arranged in a variety of orientations (e.g., inline, V-type, opposed). In the illustrated embodiment, the engine 140 is an inline, two-stroke engine having four cylinders; however, the illustrated engine type merely exemplifies one preferred form of the watercraft engine.

The engine 140 has an engine body defined by a cylinder head assembly, a cylinder body and a crankcase member. In the illustrated embodiment, the crankcase member is located near a bottom surface of the lower hull, the cylinder body is disposed above the crankcase member, and the cylinder head assembly is affixed onto of the cylinder body. A crankshaft is journalled within a crankcase formed between the cylinder body and the crankcase member and extends generally in a longitudinal direction. In the illustrated embodiment, the crankshaft functions as the engine output shaft 168. It is understood, however, that the engine can be oriented such that its crankshaft extends transversely or vertically. Regardless of the orientation of the engine within the lower hull, the engine preferably is situated such that at least half of the engine body lies below the level of a pair of outer chines 171 (see FIG. 3) on the watercraft hull.

A fuel supply system delivers fuel to the engine 140 in a known manner. The fuel supply system includes a fuel tank 172 positioned in the fuel compartment 138 located in front of the engine 140. Although not illustrated, at least one pump desirably delivers fuel from the fuel tank 172 to the engine 140 through one or more fuel lines.

A battery 174 stores power generated by the engine 40 as is also well known. The battery 174 can be used to provide power to various watercraft components. The battery can be used to start the engine 40 by providing power to for example, a starter motor. Desirably, the battery 174 is secured by a battery holder 176 that is mounted to the lower hull 106 above the tunnel 144 in the propulsion compartment 136.

The engine 140 typically draws air from the engine compartment 134 through an engine air induction system (not shown). The induction system typically comprises an air intake device disposed on the upper portion of the engine 140, which passes air from the engine compartment 134 to an air intake manifold and carburetor, which supply a fuel/air charge to a plurality of engine cylinders in a known manner. Of course, other arrangements, such as direct or indirect fuel injection, can be used to provide a fuel charge to the engine 140.

Because the engine is conventional and well known to those skilled in the art, a further description of the internal workings of the engine is not believed necessary for an understanding of the present sporting watercraft design.

An engine exhaust system 180, which is best seen in FIG. 1, typically comprises an exhaust manifold that transfers exhaust gases exiting the combustion chambers of the engine through exhaust passages to an engine exhaust pipe 182. The exhaust manifold thus generally comprises a merge chamber and a plurality of exhaust runner passages. The engine exhaust pipe 182 transfers exhaust gases to an expansion chamber 184, which subsequently transfers these exhaust gases through an exhaust pipe 186 to a watertrap 188. The watertrap 188 is a well known device that allows the passage of exhaust gases, but contains baffles (not shown) which inhibit water from passing back through the engine exhaust system 180 into the engine 140. In the present embodiment, the watertrap 188 is located behind the engine 140, slightly forward of the transom 146 of the watercraft 100. The watertrap 188 transfers the exhaust gases to exhaust pipes 190, 192, which discharges the exhaust gases to the atmosphere and/or to the water. One pipe 190 functions as a low-speed exhaust discharge and the other pipe 192 functions as a high-speed exhaust discharge. Of course, the high-speed exhaust discharge 192 can be omitted in some modes of the watercraft. For this purpose, the flow path through the high-speed exhaust pipe 192 is less restrictive than the flow path through the low-speed exhaust pipe 190; e.g., the high-speed exhaust pipe 192 has a larger diameter than that of the low-speed exhaust pipe 190.

As can be best seen from FIG. 1, an outlet end 194 of the low-speed exhaust pipe 190 is positioned at or slightly below a displacement water level $W_D$ of the watercraft 100 when operated in a displacement-hull mode to discharge exhaust gases into the water. An upstream section of the low-speed exhaust pipe is positioned above the discharge end to form a watertrap section in the pipe 190. This pipe arrangement significantly inhibits the back-flow of water through the engine exhaust system 180 into the watertrap 188 and/or the engine 140.

The high-speed exhaust pipe 192 extends from the watertrap upper end to an outlet opening 196 which is disposed on the hull at a location near the water level $W_P$ when the watercraft 100 is up on plane. The outlet opening 196 can be located on the transom 146, on a undersurface of step formed at the aft end of the hull (not illustrated), or on the lower sides surfaces of the lower hull 106; preferably, however, the outlet 196 opens into the tunnel 144 to communicate with pump chamber between the walls of the tunnel 144 and the propulsion unit 142.

When the watercraft 100 is operating in the displacement hull mode or is floating stationary, the outlet end 196 of the high-speed exhaust pipe 192 lies well below the surface level $W_D$ of the water. As a result of the back-pressure resulting from the submerged position of the outlet end 196, most, if not all, of the exhaust gases will be omitted to the water/atmosphere through the low-speed exhaust discharge 194. When the watercraft is up on plane, however, the exhaust gases will primarily flow through the high-speed exhaust discharge pipe 192.

As best seen in FIG. 1, in the disclosed embodiment the engine 140, the fuel tank 172, the battery 174 and various other internal elements of the watercraft 100 are desirably arranged within the lower hull section 106 of the watercraft, and are most desirably arranged within intermediate and lower sections of the lower hull 106. Such watercraft components, which are relatively heavy, are desirably positioned low in the watercraft to increase the stability of the watercraft 100 during both displacement and planing operations.

Moreover, the positioning of the engine 140 near the bottom of the watercraft hull 102 allows the engine 140 to be located in close proximity to the jet propulsion unit. This arrangement obviates the need for a long and/or complicated drive train to transfer power from the output shaft 168 of the engine to the impeller shaft 164. Instead, the output shaft 168 can be connected directly to the impeller shaft 164 by a suitable coupling 198 of a type which is well known in the art. Of course, if desired, a transmission system (e.g., a speed reduction and/or forward/neutral/reverse transmission) and/or a flexible coupling arrangement can be provided between the output shaft 168 and the impeller shaft 164.

Figure 3:
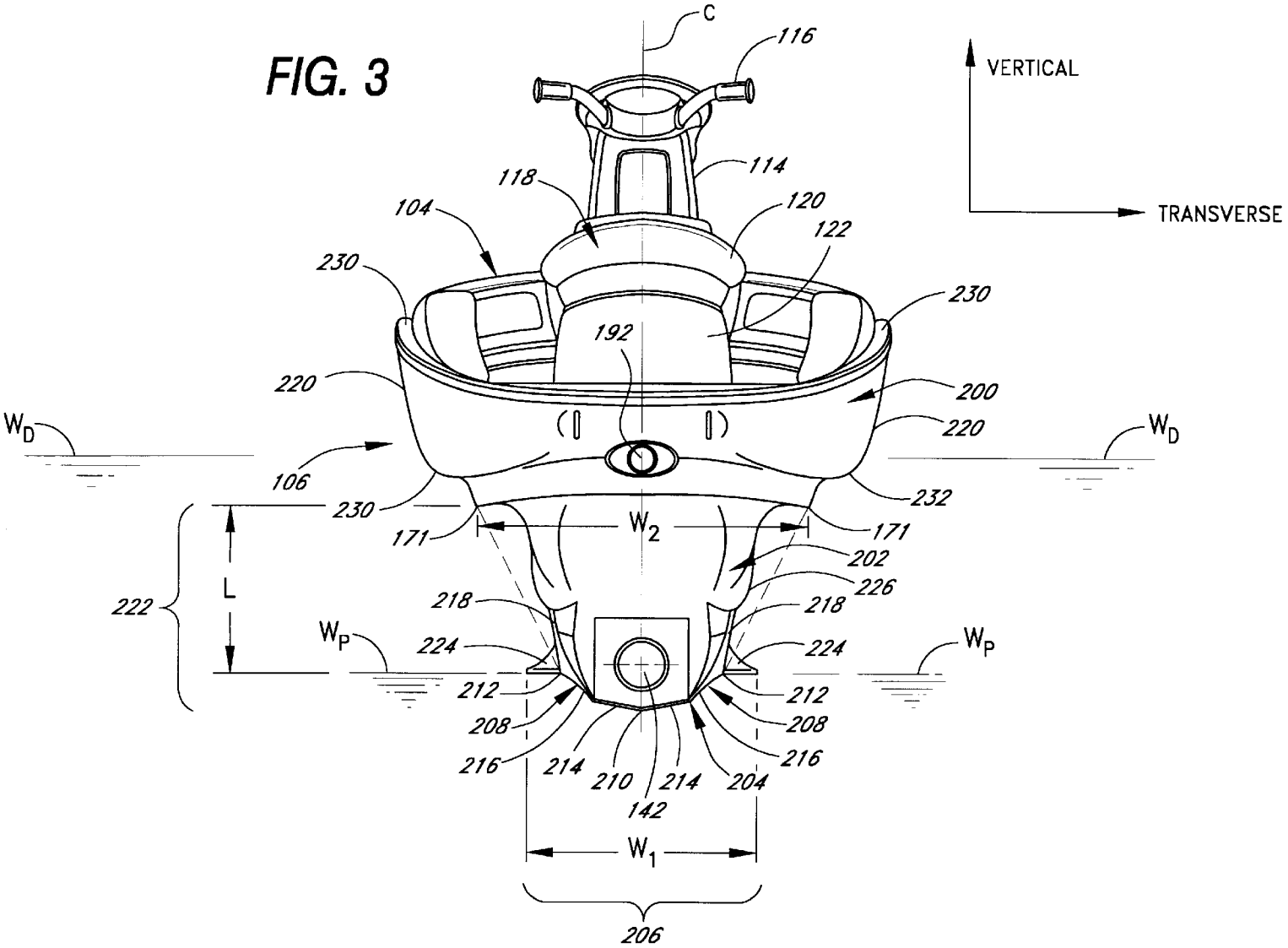
FIG. 3 is a rear elevational view of the watercraft of FIG. 1.
Figure 4:
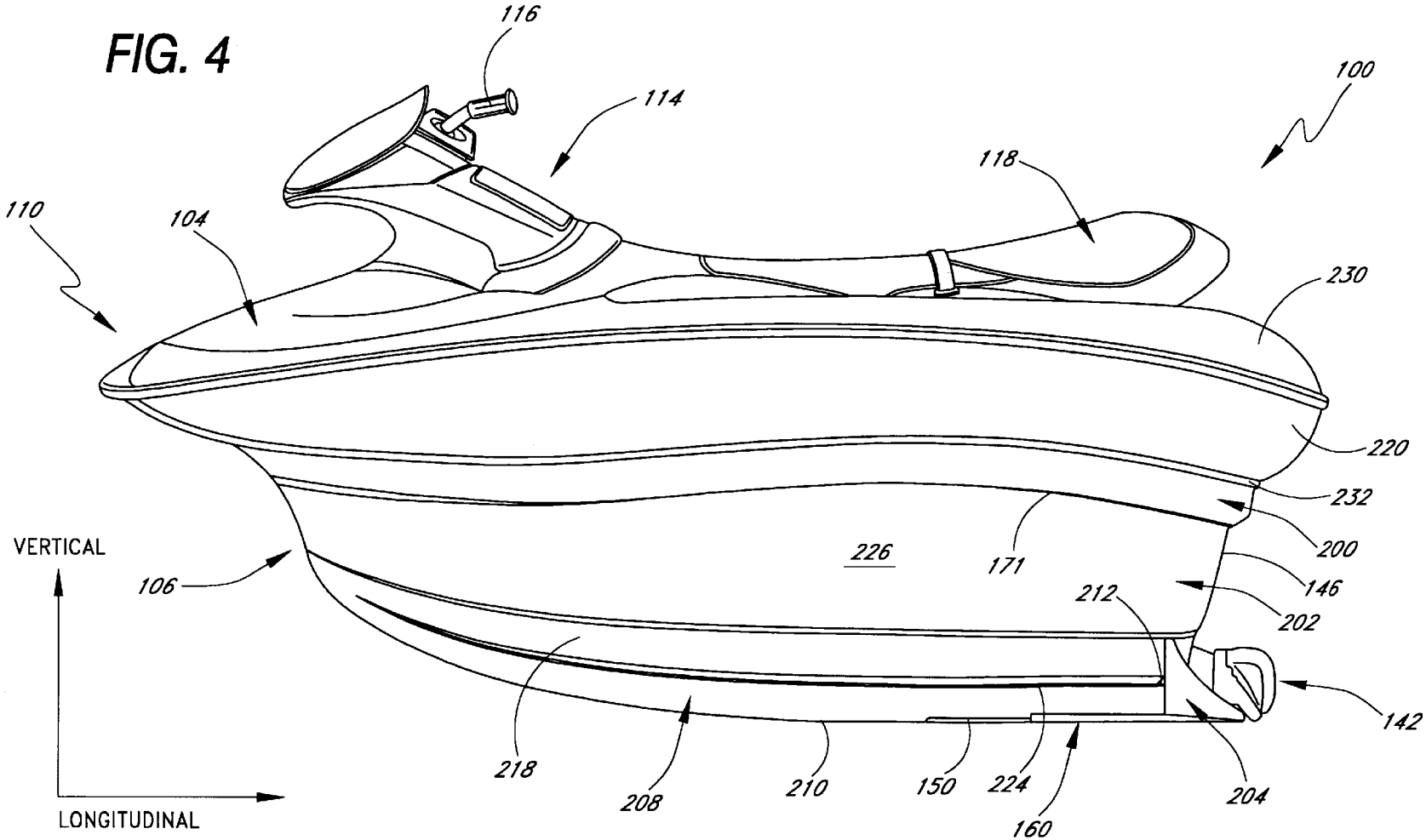
FIG. 4 is a side elevational view of the watercraft of FIG. 1.

With reference to FIGS. 3 and 4, the lower hull 106 includes an upper section 200, an intermediate section 202, and a lower section 204. The intermediate section 202 is relatively narrow as compared to the upper section 200 and has an elongated length in the vertical direction. The lower section 204 lies beneath the intermediate section 202. At least a portion of the lower section 204 defines at least part of a planing surface 206 of the watercraft 100.

In the illustrated embodiment, the lower section 204 has a generally V-shaped configuration formed by a pair of inclined sections 208 that extend transversely away from a keel line 210 to inner chines 212. The inclined sections 208 extend longitudinally from a point proximate the transom 146 of the lower hull 106 towards the bow 110. The inclined sections 208 also extend generally parallel to the longitudinal axis proximate the aft end of the watercraft 100 and then smoothly bend toward the longitudinal center C of the watercraft 100 at the bow 110. The inclined sections 208 have a compound shape toward the aft end of the watercraft (as seen in FIG. 3) and are generally planar or slightly concave along the forward portion of the watercraft (as seen in FIG. 4). Along their forward portion, the inclined sections 208 extend transversely at a dead rise angle; the dead rise angle varies along the length of the watercraft 100, being steeper toward the bow 110 of the watercraft 100.

The aft end of the lower hull 106 is designed such that the watercraft 100 planes or rides on a minimum surface area in order to optimize the speed and handling of the watercraft 100 when up on plane. For this purpose, as best seen in FIGS. 3 and 4, the lower hull includes the planing surface 206 which is defined in part by the inclined sections 208 of the lower section 204. The inclined sections 208 at the aft end of the watercraft 100, and in particular at a position aft of the water inlet 150 into to the propulsion device 142, have compound shapes. Each incline section 208 at this location of the lower section 204 is formed by two surfaces: a lower, inner surface 214 that extends transversely from the keel line 210 at a first dead rise angle; and an outer surface 216 that extends transversely from the outer edge of the corresponding inner surface 214 at a second steeper dead rise angle. The second dead rise angle desirably approximates the dead rise angle of the inclined sections 208 just forward of the water inlet 150. In the illustrated embodiment, the outer surface 216 is slightly concave and the inner surface 214 is generally planar; however, these hull surfaces can have other shapes in order to vary the handling and planing characteristics of the watercraft, as known in the art.

The ride plate 160 has a similar shape to the lower inner surfaces 214 of the inclined sections 208. The aft end of the lower hull section 204 thus has a generally constant shape and profile rearward of the propulsion unit inlet opening 150.

The intermediate section 202 is principally defined by a pair of upstanding sides that extend parallel to the longitudinally extending, central vertical plane C of the watercraft 100 proximate to the aft end and mid-section of the watercraft 100, and curve toward the central plane C at the bow 110 of the watercraft 100. Each side of the intermediate section 202 extends between corresponding inner and outer chines 212, 171 of the lower hull 106. The inner chines 212 are defined at an intersection between side walls 218 of the intermediate section sides and the inclined section 208 of the lower section 204. The outer chines 171 are defined at the intersection of the intermediate section sides and side gunnel walls 220 of the upper section 200. The intermediate section 202 and the lower section 204 form a displacement hull section 222 of the hull 100.

The intermediate section 202 has a height L, as measured along the vertical axis, that preferably is not less than about a quarter of the transverse width ($W_l/4$) of the planing surface 206, more preferably is not less than a third of the transverse width ($W_l/3$) of the planing surface 206, and most preferably is not less than half of the transverse width ($W_l/2$) of the planing surface 206. In an exemplifying embodiment, the intermediate section 202 has a height equal to or greater than 24 inches (60 cm); however, the intermediate section can be taller or shorter depending upon the application of the watercraft. The intermediate section's height though preferably is not greater than a transverse width $W_2$ between the outer chines 171.

As a consequence of the elongated height of the intermediate section 202, the propulsion axis of the propulsion device 142 is separated by a significant distance from the low-speed exhaust discharge outlet 194. This distance, as measured along the vertical axis, preferably is not less than about a quarter of the transverse width ($W_l/4$) of the planing surface 206, more preferably is not less than a third of the transverse width ($W_l/3$) of the planing surface 206, and most preferably is not less than half of the transverse width ($W_l/2$) of the planing surface 206.

The side walls 218 of the intermediate section 202 are generally upright. The side walls 218 extend longitudinally from a point proximate the transom 146 towards the bow 110. The side walls 218 are generally planar and straight (i.e., parallel to the longitudinal axis) proximate the aft end of the watercraft 100 and then smoothly bend toward the longitudinal center C of the hull 102 at the bow 110. This aft to forward shape, that bends inwardly, generally matches that of the inclined sections 218 of the lower section 204. The keel line 210 also curves upwardly toward the bow 110 to reduce the transverse height of the inclined sections 208 and the vertical height of the side walls 218 proximate the bow 110 of the watercraft 100.

A pair of wings or sponsons 224 are disposed on the sides walls 218 of the lower hull 106 at inner chines 212 on the lower hull section 106. In the illustrated embodiment, a generally flat, transversely extending surface projects from the lower section 204 at the location of the inner chine 212. These sponsons 224 form a portion of the planing surface 206 when the watercraft 100 is up on plane. However, it is understood that the sponsons could be omitted, and in such case, the planing surface 206 would be defined by the aft end of the lower section 204.

The sponsons 224 taper is size and width toward the bow 110 of the watercraft 100 and smoothly blend into the front bow section of the lower hull portion 106, as seen in FIG. 4. The sponsons 224, however, need not extend along the entire length of the hull 102, but rather can extend only along the aft end of the hull lower portion 106.

The intermediate section 202 includes a bulge portion 226 that lies above the side walls 218. The bulge 226 is defined by the surfaces of the intermediate section 202 bowing in the fore to aft direction and also in the vertical direction. That is, the bulge 226 occurs toward the center of the hull 106 in the fore to aft direction, and about at a mid-level of the intermediate section's height. The intermediate section 202 thus has a reduced transverse width at both its fore and aft ends in comparison to its transverse width at about its longitudinal midpoint. Similarly, the intermediate section 202 has a smaller width both above and below its mid-level at its longitudinal midpoint. The maximum transverse width of the intermediate section 202 at the bulge portion 226 preferably is less than a maximum transverse width of the upper section 200, more preferably is less than a transverse width between the outer chines 171 of the lower hull 106, and most preferably is equal to or less than the width of the planing surface 206.

As seen in FIG. 3, each side surface of the intermediate section 202 extends inward from the outer chines 171 toward the longitudinally extending, central vertical plane C of the watercraft 100. The surfaces extend generally normal to the vertical plane C and then curve downward into the midsection of the intermediate section 202. The intermediate section 202 thus has significantly less volume than a V-shaped section of a hull that is defined between the inner and outer chines 212, 171, as schematically represented in FIG. 3. As used in this context, "significantly less volume" means; a greater reduction in volume than would result from the inclusion of conventional strakes and chines formed on the V-shaped section. In this regard, the volume of the lower hull 106 is reduced by not less than about ten percent, and more preferably by about twenty percent as a result of the shape of the intermediate section 202 as compared to a V-shaped hull section defined between the inner and outer chines 212, 171.

The upper section 200 defines the gunnels 230 of the watercraft. The outer side surfaces of the upper section 200 are generally upright and then curve inward and downward toward the outer chines 171. This shape provides a strake 232 along each gunnel side 220 at a point just below the water displacement line $W_D$ of the watercraft 100. This shape also reduces the volume of the upper section 200.

As best seen in FIG. 4, the aft end of the upper section 200 is rounded and curves inwardly toward the upper end of the intermediate section 202. In the illustrated embodiment, aft end curves inwardly to a first point corresponding to the level of the strakes 232 along the sides of the gunnel sides 220. The curved surface has a generally constant radius of curvature. The aft end then follows a second, smaller radius of curvature and terminates at the upper end of the intermediate section 202 (i.e., it the level of the outer chines 171).

The lower hull 106 desirably has a unified construction, i.e., the upper, intermediate and lower sections, as well as the sponsons, are unitarily formed. For example, a hull mode for the entire lower hull can be formed and either fiberglass or SMC be placed in the mold to form the lower hull as a single piece. The lower hull 106, however, can be formed of multiple piece, although this is less preferred. For example, the sponsons 224 can be affixed to the lower hull 106 rather than be unitarily formed with it. In such case, it also is possible to affix the sponsons 224 to the hull in a manner that permits adjustment of an orientation of at least part of each sponson 224 on the lower hull 106.

As can be best understood from FIG. 3, the lower hull 106 of the watercraft 100 acts as a displacement-type hull during low-speed operation as a result of its construction. A displacement-type watercraft hull supports the weight of a watercraft by displacing an amount of water equal to the weight of the watercraft. For example, the hull of a floating 350 kg watercraft must displace at least 350 kg of water, or it will sink. Because fresh water at 25° C. has a density of 997 kg/m$^3$, this means that the hull of the watercraft operated in fresh water must have a submerged volume of at least 0.351 $m^3$. Of course, as the weight of this watercraft increases or decreases, the amount of water which must be displaced will commensurately increase or decrease. Typically, as the weight of the watercraft increases (such as where personnel and/or cargo is added to the watercraft), the hull will sink lower in the water, displacing additional water in response to the increased weight of the watercraft.

As another example, for a watercraft operating in salt water, the hull of the floating 350 kg watercraft must displace at least 350 kg of water, or it will sink. Because salt water at 25° C. has a density of approximately 1,025 $kg/m^3$, this means that the hull of the watercraft operated in salt water must have a submerged volume of at least 0.341 $m^3$. Of course, as previously noted, as the weight of the watercraft increases or decreases, the amount of salt water which must be displaced will commensurately increase or decrease.

In contrast, a planing-type hull supports the weight of a watercraft by planing or "skipping" over the surface of the water. Because a planing watercraft is moving at much greater velocity than the water, and the water has significant mass, the water essentially acts similar to a solid surface, with the hull sliding along the top of the water. As the speed of the planing watercraft decreases, however, the planing hull typically begins to "dig" into the water, and drag on the hull significantly increases. If the speed of the watercraft continues to drop, the watercraft hull will experience less and less planing support, and will eventually operate as a displacement-type hull.

The watercraft 100 includes an arrangement of an engine 140 and associated components within a hull 102 of the watercraft 100 in accordance with a preferred embodiment of the present invention. As can be best seen from FIGS. 3 and 4, the lower hull 106 incorporates the vertically elongated displacement hull section 222. The displacement hull section 222 is elongated generally along the vertical axis of the hull 102 and significantly increases the overall vertical dimension of the lower hull 106. Accordingly, the displacement hull section 222 greatly increases the vertical separation between the seat assembly 118 and the planing surface 206 of the watercraft 100 as compared to previously existing watercraft. When the disclosed watercraft goes up on plane, the operator and/or riders of the watercraft will be suspended a significant vertical distance above the water surface, which induces a "flying feeling" and illusion of great speed to the operator and/or riders. In addition, the increased separation between the operator/riders and the planing surface 206 significantly increases the visibility of the operator, as well as increases the visibility of the planing watercraft, thereby significantly increasing operating safety.

An additional advantage of the elongated displacement hull 222 is that the storage capacity of the watercraft is significantly increased. Because the elongated displacement hull section accommodates all the basic propulsion components (e.g., the engine and the exhaust system), much of the remaining hull volume can be utilized as additional storage space. Accordingly, as shown in FIG. 1, the cargo box 128 can extend below the displacement waterline $W_D$.

In order to achieve at least some of the benefits mentioned above, the elongated section 222 section preferably has a vertical height of at least half the width of the planing surface 206. Most preferably, the elongated section 222 has a height greater than or equal to 24 inches (610 millimeters).

As best seen in FIG. 3, in the disclosed embodiment the transverse width of the elongated displacement hull section 222 of the lower hull section 106 is significantly less than the transverse width of the watercraft 100 across the gunnels 230. This reduced transverse width results in a significantly reduced volume of the elongated displacement hull section 222. For example, it has been determined that the volume occupied by the elongated displacement hull section 222 can be approximated by the formula:

$$\text{Volume of hull}=\text{Length}\times\text{Breadth}\times\text{Height}\times 80\%$$

Thus, for the disclosed embodiment, the volume of the elongated displacement hull section 222 would be:

$$V=1.5\ \text{m}\times 0.5\ \text{m}\times 0.5\ \text{m}\times 80\%$$

or $$V=0.3\ \text{m}^3$$

Because water at 25° C. has an average density of 997 kg/m3, this would result in a displaced volume of 0.3 $m^3\times 1{,}000\ kg/m^3$, or approximately 299.1 kg of water. Thus, as is well known in the art, submergence of the elongated displacement hull section will result in a buoyant force of approximately 299.1 kg.

Because the disclosed watercraft 100 weighs approximately 350 kg, the 299.1 kg of buoyant force induced by the elongated displacement hull section 196 will not, by itself, support the entire weight of the watercraft, and thus the elongated displacement hull section 222 will be desirably entirely submerged by the weight of the watercraft 100 when in displacement hull-type operation. Accordingly, the reduced volume of the elongated displacement hull section 222 results in a watercraft which rides lower in the water during displacement-hull operation for a given loading, and thus the stability of the watercraft during displacement-hull operation is significantly increased.

As previously noted, the planing surface 206 of the watercraft 100 incorporates a pair of sponsons 224 which provide additional surface area upon which the watercraft can plane. However, because these sponsons 224 extend outward from the elongated displacement hull section 222, and do not displace a significant amount of water, these wings do not add appreciably to the buoyant forces acting on the underside of the hull 102 of the watercraft 100. In addition, the sponsons 224 increase the stability of the watercraft during planing hull-type operation by increasing the transverse width of the planing surface upon which the watercraft planes.

As shown in FIGS. 3 and 4, the elongated displacement hull section 222 desirably incorporates the bulged section 226 which is sized to accommodate the engine 140 of the watercraft 100 within the elongated displacement hull section 222. The transverse width of the bulged section 226 is desirably wide enough to accommodate the engine 140 of the watercraft 100. In addition, the bulged section 226 desirably extends upwards toward the upper deck section 104 of the watercraft 100 to facilitate installation and removal of the watercraft engine 140 in its entirety for maintenance. By bulging the elongated displacement hull section 222 in this manner, the engine 104 can be desirably positioned near the bottom of the hull 102 while the overall volume of the elongated displacement hull section 222 remains minimized.

Figures 5A, 5B, 5C:
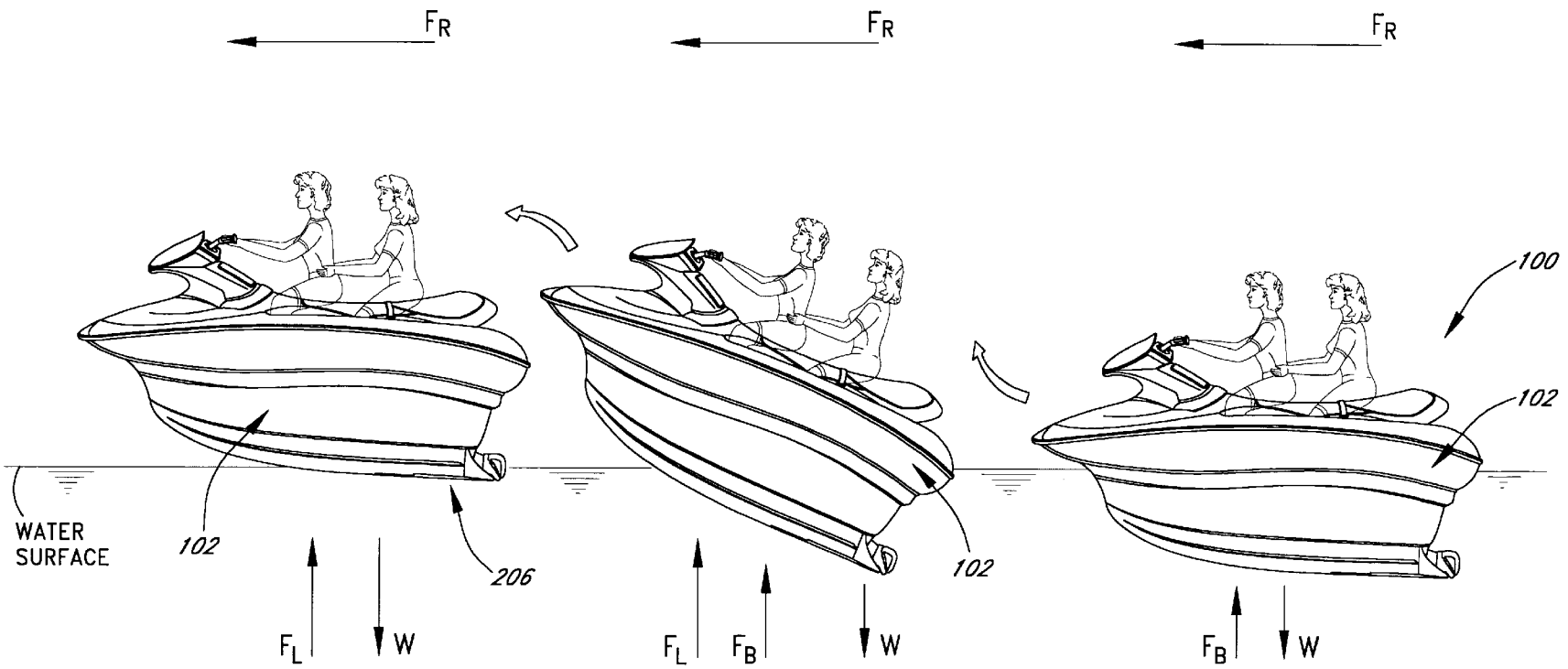
FIG. 5*a* is a side elevational view of the watercraft of FIG. 1 during low-speed displacement hull-type operation.
FIG. 5*b* is a side elevational view of the watercraft of FIG. 5*a* during the transition phase from lower-speed displacement hull-type operation to higher-speed planing hull-type operation.
FIG. 5*c* is a side elevational view of the watercraft of FIG. 5*b* during higher-speed planing hull-type operation.

With initial reference to FIG. 5*a,* the waterline surrounding the watercraft 100 during low-speed, displacement hull-type operation will be approximately at the level of $W_D$, depending upon the number and weight of riders, supplies, and the amount of fluids within the watercraft 100. At this point, the buoyancy force $F_B$ acting on the bottom of the watercraft will equal the weight W of the loaded watercraft. As the speed of the watercraft increases, however, the planing surface 206 of the hull 102 will begin to "ride over" the water, with the planing surface beginning to act as a planing-type hull. This planing action results in a lifting force $F_L$, acting on the underside of the hull, which, in conjunction with the buoyant force $F_B$, equals the weight W of the watercraft 100. Because less buoyant force $F_B$ is required to maintain the floating watercraft at this point, the watercraft rides higher in the water, as shown in FIG. 5*b,* and drag forces acting on the hull 102 of the watercraft 100 tend to reduce. As the speed of the watercraft 100 continues to increase, as shown in FIG. 5*c,* the planing surface 206 of the watercraft 100 will eventually plane along the surface of the water, and the lifting force $F_L$ essentially counteracts the weight W of the watercraft 100, with little or no buoyant force $F_B$ acting on the hull 102.

As best seen in FIGS. 1 and 3, during displacement hull-type operation of the watercraft 100, the waterline $W_D$ remains significantly higher than the upper surface of the bulkhead 132 between the engine compartment 134 and the propulsion compartment 136. While the cargo box 128 and pad 129 desirably seal the engine compartment 134 in a watertight manner, as previously noted, it is possible that water leaking into the propulsion compartment 136 could possibly pass over the bulkhead 132 and enter the engine compartment 134. In order to avoid this occurrence, and the attendant "swamping" and/or sinking of the watercraft which might result, an electric sump or bilge pump (not shown) may be provided that automatically removes water from the engine and/or propulsion compartments 134, 136.

The disclosed embodiment also facilitates a quick transition of the watercraft from a high-speed planing hull-type operation to a low-speed displacement hull-type operation. As best seen in FIG. 3, during high-speed planing hull-type operation, the majority of the watercraft hull 102 is suspended well above the waterline $W_P$, with essentially only the smaller planing surface 206 in contact with the water. However, when propulsive power to the jet pump unit of the planing watercraft is reduced significantly, such as when the throttle control is released, the watercraft begins to slow and the hull 102 quickly begins to "dig" into the water surface. This "digging" increases the amount of hull surface area in contact with the water (i.e., it increases the wetted surface area), which significantly increases drag on the hull 102, farther reducing the speed of the watercraft and causing more of the watercraft hull to submerge. As the hull 102 of the watercraft 100 continues to submerge, the wetted surface area continues to increase, and in addition a "bow wave" begins to form in the water in front of the elongated displacement hull section 222. This "bow wave," which results from the transverse cross-sectional area of the elongated displacement hull section 222 attempting to move through the water, further impedes the watercraft's travel through the water, which further slows the moving watercraft. As a result, once propulsive power is reduced, the planing watercraft quickly re-enters the water, transferring from a planing hull-type operation to a displacement hull-type operation in a relatively short time over a relative short distance.

Figures 6A, 6B, 6C:
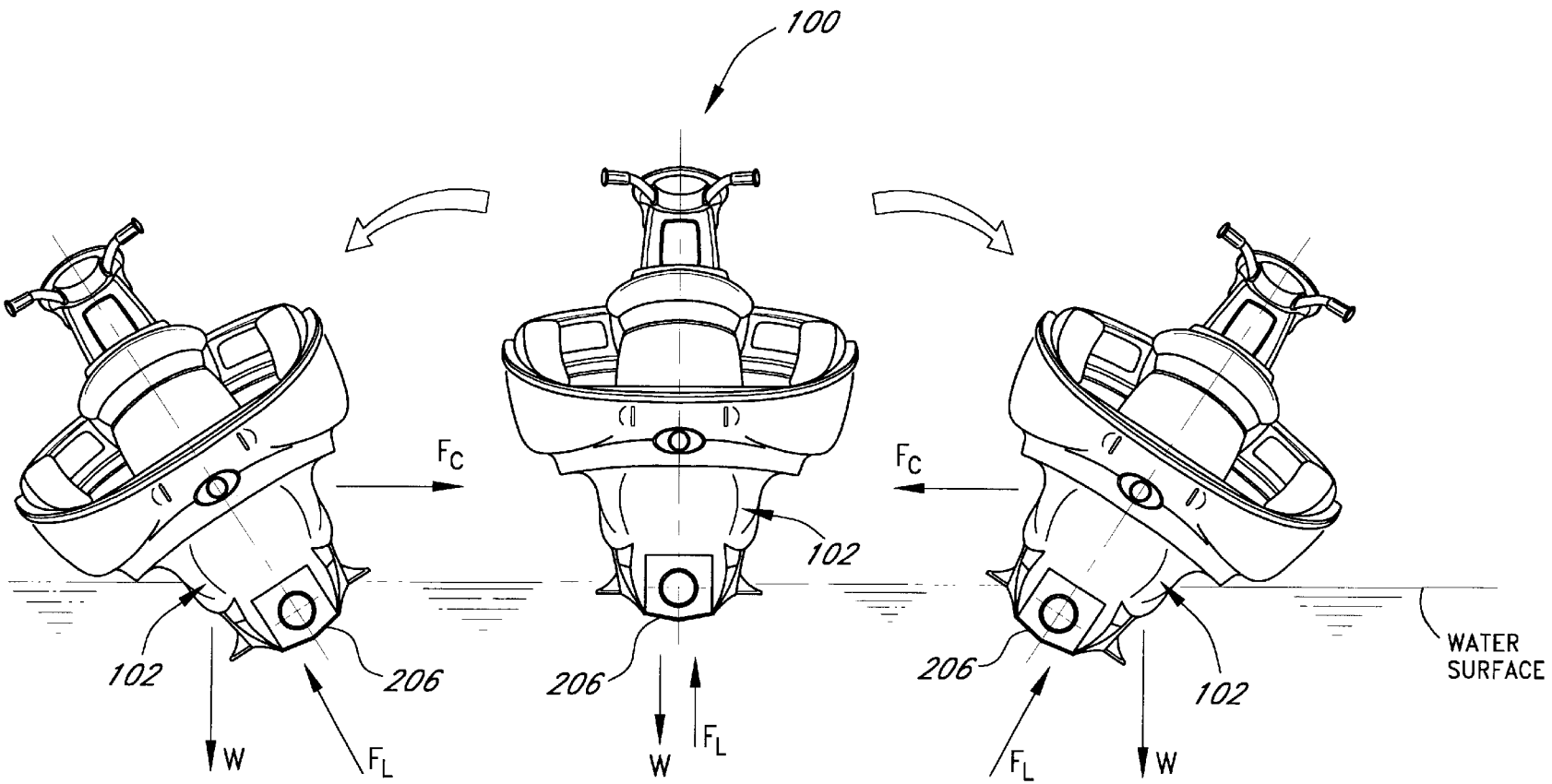
FIG. 6*a* is a rear elevational view of the watercraft of FIG. 1 during higher-speed planing hull-type operation.
FIG. 6*b* is a rear elevational view of the planing watercraft of FIG. 6*a* when turning to the port side.
FIG. 6*c* is a rear elevational view of the planing watercraft of FIG. 6*a* when turning to the starboard side.

FIGS. 6*a,* 6*b* and 6*c* depict varying orientations of the disclosed watercraft while maneuvering up on plane. As can be best seen from FIG. 6*b,* when the planing watercraft undergoes a port turn, the watercraft will experience a centripetal force $F_C$ acting to starboard, resulting from inertia resisting the maneuvering of the watercraft 100. To counter this centripetal force $F_C$, the operator/riders will desirably "lean into" the port turn, similar to maneuvering a motor cycle through a turn, which results in a re-orientation of the weight W (relative to the watercraft), and a re-orientation or "tilting" of the planing surface 206 of the watercraft 100. Desirably, the port sponson 224 will "dig" into the surface of the water, and little or none of the starboard sponson 224 will extend above the surface of the water, which would result in a lifting force which continues to act through the longitudinal axis of the watercraft 100. This tilting of the watercraft about the longitudinal axis results in a tilting of the line of action of the lifting force $F_L$ acting on the planing surface 206 of the watercraft 100, which desirably counteracts the effects of the centripetal force $C_F$ acting on the watercraft 100. In this manner, the forces acting on the watercraft 100 will balance, and the watercraft will smoothly travel through the desired turn.

FIG. 6C depicts the watercraft of FIG. 6*a* undergoing a starboard turn. As previously discussed in connection with FIG. 6*b,* the forces acting on the maneuvering watercraft are desirably balanced by a tilting of the watercraft about the transverse axis, similar to leaning into a turn on a motorcycle.

Although this invention has been described in terms of certain embodiments, other embodiments apparent to those of ordinary skill in the art also are within the scope of this invention. Thus, various changes and modifications may be made without departing from the spirit and scope of the invention. For example, the present invention could be used in conjunction with a watercraft such as a jet boat or the like. Accordingly, the scope of the invention is intended to be defined only by the claims that follow.

What is claimed is:

1. A small watercraft comprising a hull including a lower hull and an upper deck, the upper deck including a raised pedestal, a pair of gunnels that are positioned on opposite sides of the raised pedestal and pair of longitudinally extending foot areas positioned on opposite sides of the raised pedestal between the pair of gunnels and the raised pedestal, the lower hull including an upper section, an intermediate section, and a lower section having a planing surface, the planing surface having a width defined along a transverse axis of the watercraft, the intermediate section lying between the planing surface and a water displacement line of the watercraft, the intermediate section being vertically elongated such that a height of the intermediate section, as measured along a vertical axis, is not less than about half the width of the planing surface.

2. A small watercraft as in claim 1, wherein the intermediate section has a location of a maximum width, and the maximum width of the intermediate section is not greater than about the maximum width of the planing surface.

3. A small watercraft as in claim 2, wherein the width of the lower section is generally equal to the width of the planing surface.

4. A small watercraft as in claim 1, wherein the outer chines are spaced apart from each other by a transverse width, and the height of the intermediate section is not greater than the transverse width between the outer chines.

5. A small watercraft as in claim 1, wherein the intermediate section includes a pair of sides that, at least at the aft ends thereof, extend generally parallel to a longitudinally extending, central vertical plane of the watercraft.

6. A small watercraft as in claim 5, wherein the pair of sides have a length in a vertical direction that is greater than or equal to 24 inches (60 cm).

7. A small watercraft as in claim 1 additionally comprising a prime mover that lies at least partially below the upper section of the lower hull.

8. A small watercraft as in claim 7, wherein the intermediate section includes a bulged portion in which the prime mover is disposed.

9. A small watercraft as in claim 8, wherein the intermediate section includes a higher portion above the bulged portion, and the higher portion has a width that is less than the maximum width of the bulged portion.

10. A small watercraft as in claim 1, wherein the upper deck includes a raised pedestal, and wherein the small watercraft additionally comprises a seat assembly located above the raised pedestal and a storage area formed within the raised pedestal.

11. A small watercraft as in claim 10, wherein at least a portion of the storage area lies below the water displacement line.

12. A small watercraft as in claim 1, wherein the lower hull includes a pair of sponsons disposed on the intermediate section.

13. A small watercraft as in claim 12, wherein the lower section includes a pair of inner chines, and the sponsons are positioned on the lower hull so as to extend the planing surface outwardly beyond the inner chines of the lower section.

14. A small watercraft as in claim 12, wherein the sponsons are unitarily formed with the intermediate section of the lower hull.

15. A small watercraft as in claim 1, wherein the lower section includes a pair of inner chines, and the planing surface is defined between the pair of inner chines.

16. A small watercraft as in claim 1, wherein the upper, intermediate and lower sections of the lower hull are unitary.

17. A small watercraft comprising a hull including a lower hull and an upper deck, the lower hull including an upper section, an intermediate section, and a lower section having a planing surface, the planing surface having a width defined along a transverse axis of the watercraft, the intermediate section lying between the planing surface and a water displacement line of the watercraft, the intermediate section being vertically elongated such that a height of the intermediate section, as measured along a vertical axis, is not less than about half the width of the planing surface, additionally comprising a first exhaust outlet and a second exhaust outlet, the first exhaust outlet being disposed proximate to the water displacement line of the watercraft, and the second exhaust outlet being disposed proximate to the planing surface of the hull.

18. A small watercraft comprising a propulsion system and a hull including a lower hull and an upper deck, the upper deck defining a pair of substantially flat footwells, the lower hull including an upper section, an intermediate section located below the footwells, and a lower section defining at least part of a planing surface of the watercraft, the planing surface having a width defined along a transverse axis of the watercraft, the intermediate section disposed between the planing surface and a water displacement line of the watercraft, the intermediate section having a maximum width that is not greater than the width of the planing surface, the propulsion system including an engine having an engine body and a crankcase, the crankcase being located below the water displacement line.

19. A small watercraft as in claim 18, wherein the intermediate section also has a height in a vertical direction that is not less than about a half the width of the planing surface.

20. A small watercraft as in claim 18, wherein the intermediate section also has a height in a vertical direction that is greater than or equal to 24 inches (600 mm).

21. A small watercraft as in claim 18, wherein the upper section of the hull includes a pair of outer chines which are spaced apart from each other by a transverse width, and the height of the intermediate section is not greater than the transverse width between the outer chines.

22. A small watercraft as in claim 21, wherein the intermediate section includes a bulged portion in which a prime mover is disposed.

23. A small watercraft as in claim 18, additionally comprising a prime mover disposed within the lower hull at least partially below the upper section of the lower hull.

24. A small watercraft as in claim 23, wherein the intermediate section includes a higher portion above a bulged portion, and the higher portion has a width that is less than a maximum width of the bulged portion.

25. A small watercraft as in claim 24, wherein at least a portion of a storage area lies below the water displacement line.

26. A small watercraft as in claim 18, wherein the upper deck includes a raised pedestal, and wherein the small watercraft additionally comprises a seat assembly located above the raised pedestal and a storage area formed within the raised pedestal.

27. A small watercraft as in claim 18, wherein the lower hull includes a pair of sponsons disposed on the intermediate section.

28. A small watercraft as in claim 27, wherein the lower section includes a pair of inner chines, and the sponsons are positioned on the lower hull so as to extend the planing surface outwardly beyond the inner chines of the lower section.

29. A small watercraft as in claim 27, wherein the sponsons are unitarily formed with the intermediate section of the lower hull.

30. A small watercraft as in claim 18, wherein the lower section includes a pair of inner chines, and the planing surface is defined between the pair of inner chines.

31. A small watercraft as in claim 18, wherein the upper, intermediate and lower sections of the lower hull are unitary.

32. A small watercraft comprising a hull defining a planing surface, the planing surface having a width in a transverse direction, an internal combustion engine disposed within the hull, a propulsion device being driven by the engine and being disposed such that a propulsion axis of the propulsion device lies near the planing surface of the hull, and an exhaust system communicating with the engine and extending to and terminating at an exhaust outlet to discharge exhaust gases generated by the engine, the exhaust outlet located near a water displacement line of the watercraft, the propulsion axis of the propulsion device and the exhaust outlet being separated by a vertical distance not less than about half the width of the planing surface.

33. A small watercraft as in claim 32, wherein the propulsion unit comprises a jet pump including a downward facing inlet and an outlet to discharge water along the propulsion axis from the jet pump.

34. A small watercraft as in claim 32, wherein a jet pump outlet is located directly below the exhaust outlet.

35. A small watercraft as in claim 32, wherein the exhaust outlet is disposed at a position vertically higher than the engine.

36. A small watercraft as in claim 32, wherein the distance between the propulsion axis and the exhaust outlet is greater than or equal to 24 inches (600 mm).

37. A small watercraft comprising a hull defining a planing surface, the planing surface having a width in a transverse direction, an internal combustion engine disposed within the hull, a propulsion device being driven by the engine and being disposed such that an axis of the propulsion device lies near the planing surface of the hull, and an exhaust system communicating with the engine and extending to and terminating at an exhaust outlet to discharge exhaust gases generated by the engine, the exhaust outlet located near a water displacement line of the watercraft, the axis of the propulsion device and the exhaust outlet being separated by a vertical distance not less than about half the width of the planing surface, wherein the exhaust system includes a second exhaust outlet to discharge exhaust gases generated by the engine, and the second exhaust outlet is located near the propulsion axis of the propulsion device.

38. A small watercraft comprising hull including an upper deck having a raised pedestal, a pair of gunnels that are positioned on opposite sides of the raised pedestal and a pair of longitudinally extending foot areas that are also positioned on opposite sides of the raised pedestal between the pair of gunnels and the raised pedestal, the hull also including lower hull comprising an upper section having a pair of outer chines, an intermediate section located below the longitudinally extending foot areas, and a lower section defining a planing surface, the outer chines and the lower section being symmetrically positioned relative to a central vertical plane of the hull that extends longitudinally, the lower section being disposed below and between the outer chines, the lower section including a pair of inner chines defined along outer edges of the lower section, the intermediate section including a pair of sides, each side extending between one of the outer chines and a corresponding one of the inner chines, at least a portion of each side of the intermediate section extending inwardly toward the central vertical plane and sufficiently deviating from a line extending from the corresponding outer to inner chines so as to significantly reduce the volume of the hull beneath the outer chines.

39. A small watercraft as in claim 38, wherein the inner chines extend in a longitudinal direction generally parallel to the outer chines.

40. A small watercraft as in claim 38, wherein the intermediate section has a variable width between the sides of the intermediate section, the intermediate section also includes a bulged portion that defines a maximum width with the width of the intermediate section narrowing both above and below the bulged portion.

41. A small watercraft as in claim 38 additionally comprising a jet pump unit, a portion of the lower section defining at least part of a tunnel formed at an aft end of the lower hull, and the jet pump unit being disposed at least partially within the tunnel.

42. A small watercraft as in claim 41, wherein the tunnel extends upward into the intermediate section.

43. A small watercraft as in claim 38, wherein the planing surface has a complex configuration defined in part by multiple surface sections on the lower section of the hull.

44. A small watercraft as in claim 43, wherein at least some of the surface sections have a curvilinear shape.

45. A small watercraft as in claim 43, wherein at least some of the surface sections are generally flat and are disposed at inclined orientations.

46. A small watercraft as in claim 38, wherein the lower hull includes a pair of sponsons disposed on the intermediate section.

47. A small watercraft as in claim 46, wherein the sponsons are positioned on the lower hull so as to extend the planing surface outwardly beyond the inner chines of the lower section.

48. A small watercraft as in claim 46, wherein the sponsons are unitarily formed with the intermediate section of the lower hull.

49. A small watercraft as in claim 38, wherein the planing surface is defined between the pair of inner chines.

50. A small watercraft as in claim 38, wherein the upper section, and the intermediate and lower sections of the lower hull are unitary.

51. A small watercraft as in claim 38, wherein the intermediate section has a vertically elongated shape of a height that is not less than about half of the width of the planing surface.

52. A small watercraft as in claim 51, wherein the lower section includes a maximum width and the intermediate section includes a maximum width, and the maximum width of the intermediate section is not greater than about the maximum width of the lower section.

53. A small watercraft as in claim 52, wherein the width of the lower section is generally equal to the width of the planing surface.

54. A small watercraft as in claim 51, wherein the intermediate section includes a pair of sides that, at least at the aft ends thereof, extend generally parallel to a longitudinally extending, central vertical plane of the watercraft.

55. A small watercraft as in claim 38 additionally comprising a prime mover that lies at least partially below the outer chines of the hull.

56. A small watercraft as in claim 38, wherein the intermediate section has a vertically elongated shape of a height that is greater than or equal to 24 inches (60 cm).

57. A small watercraft comprising a hull including an upper deck having a raised pedestal, a pair of gunnels that are positioned on opposite sides of the raised pedestal and a pair of longitudinally extending foot areas positioned on opposite sides of the raised pedestal between the pair of gunnels and the raised pedestal, the hull also including lower hull comprising an upper section having a pair of outer chines, an intermediate section, and a lower section defining a planing surface, the lower section being disposed below and between the outer chines, the lower section including a pair of inner chines along outer edges of the lower section, the intermediate section extending between the outer chines and the inner chines and being located below the longitudinally extending foot areas, the intermediate section being configured to significantly reduce the volume of the hull below the outer chines in comparison to a hull volume defined by a generally v-shape construction between the inner and outer chines, the upper deck and the lower hull defining, at least partially, a continuous surface, that extends from the gunnels, through the upper section and to the intermediate section.

58. A small watercraft as in claim 57, wherein the intermediate section is also configured to separate the planing surface from a water displacement line of the watercraft by a distance that is greater than or equal to 24 inches (60 cm).

59. A small watercraft comprising a hull including an upper deck having a raised pedestal, a pair of gunnels that are positioned on opposite sides of the raised pedestal, the hull also including lower hull comprising an upper section having a pair of outer chines and a lower section defining a planing surface, the lower section being disposed below and between the outer chines, the lower section including a pair of inner chines along outer edges of the lower section, the inner chines extending generally parallel to the outer chines, an intermediate section extending between the outer chines and the inner chines, the intermediate section including means for reducing the volume of the hull below the outer chines so that the hull has a water displacement line significantly higher on the hull, the lower hull defining, at least partially, a continuous surface, that extends from the gunnels, through the upper section and to the intermediate section.

60. A small watercraft as in claim 59, wherein the planing surface is located a distance that is greater than or equal to 24 inches (60 cm) below the water displacement line of the watercraft.

61. A small watercraft comprising a hull including an upper deck having a pair of gunnels, and a lower hull, the lower hull including an upper section having a pair of outer chines, an intermediate section, and a lower section including a planing surface, the upper deck supporting an elongated, longitudinally extending seat with a steering column positioned forward of the seat, and a propulsion system supported by the hull, the propulsion system including an engine having an engine body and a jet pump that is driven by the engine to propel the watercraft, the engine being supported within the hull and disposed such that at least half of the engine body lies below a level of the outer chines, the hull defining a continuous surface that extends from the gunnels to the intermediate section.

62. A small watercraft as in claim 61, wherein the steering column has an upper end and lower end that is rearwardly disposed of the upper end.

* * * * *

UNITED STATES PATENT AND TRADEMARK OFFICE

CERTIFICATE OF CORRECTION

PATENT NO. : 6,422,168 B1
DATED : July 23, 2002
INVENTOR(S) : Kobayashi, Noboru

It is certified that error appears in the above-identified patent and that said Letters Patent is hereby corrected as shown below:

Column 19,
Line 12, change “comprising hull” to -- comprising a hull --.

Signed and Sealed this

Twenty-third Day of September, 2003

JAMES E. ROGAN
*Director of the United States Patent and Trademark Office*